United States Patent [19]

Faris et al.

[11] 4,193,411

[45] Mar. 18, 1980

[54] POWER-OPERATED SMOKING DEVICE

[75] Inventors: Ted V. Faris, Westminster; Sanford W. French, IV, Costa Mesa, both of Calif.

[73] Assignee: Raymond W. Reneau, Westminster, Calif.

[21] Appl. No.: 805,961

[22] Filed: Jun. 13, 1977

[51] Int. Cl.[2] ..... A24F 1/10; A24F 47/00

[52] U.S. Cl. ..... 131/171 R; 131/224

[58] Field of Search ..... 131/171 R, 178, 185, 131/186, 187, 195, 226, 224, 222

[56] References Cited

U.S. PATENT DOCUMENTS

| | | | |
|---|---|---|---|
| 402,681 | 5/1889 | Lindeman | 131/171 R |
| 1,336,233 | 4/1920 | Ivory | 131/179 X |
| 2,996,066 | 8/1961 | Marquette | 131/178 X |
| 3,363,633 | 1/1968 | Weber | 131/178 |
| 3,834,402 | 9/1974 | Paul | 131/205 |
| 3,994,304 | 11/1976 | Loeffler | 131/171 R |

FOREIGN PATENT DOCUMENTS

| | | | |
|---|---|---|---|
| 1518079 | 2/1968 | France | 131/171 R |

*Primary Examiner*—Stephen C. Pellegrino
*Attorney, Agent, or Firm*—Francis X. Lo Jacono

[57] ABSTRACT

A power-operated smoking device comprising a housing having a bowl adapted to receive a cup therein, wherein the tobacco to be smoked is placed in the removable cup. Positioned adjacent the bowl and communicating therewith is an air chamber through which air is drawn from the bowl portion by a fan mechanism, the smoke then being forced through the outlet stem of the pipe. The housing also includes a lower body section arranged to receive the fan motor and a power supply unit, the outlet stem being arranged to support an extended mouthpiece whereby a person directly receives the smoke therefrom.

4 Claims, 6 Drawing Figures

POWER-OPERATED SMOKING DEVICE

BACKGROUND OF THE INVENTION

1. Field of the Invention

This invention relates generally to a smoking device and, more particularly, to a smoking device that includes a fan mechanism to provide a continuous flow smoke therethrough.

2. Description of Prior Art

As is well known in the art, various types of smoking devices have been suggested and employed to enable individuals to give up smoking—or, for those who desire to continue, a means whereby the smoke is filtered before the person inhales.

In U.S. Pat. No. 3,918,464, there is disclosed a smoking device that allows the tobacco to be electrically burned and the smoke therefrom to be drawn through a manifold which incorporates water therein through which the smoke is bubbled to effect a cooling and filtration thereof.

There is further disclosed in British Pat. No. 606,991 a tobacco pipe or cigarette holder that is designed particularly for providing a smoking device that includes nicotine traps, filters and a smoke-cooler means.

U.S. Pat. No. 3,695,275 discloses a cigarette-smoking device wherein the main object is to assist an individual to cease smoking by providing a cigarette holder that does not allow the smoke therefrom to enter the individual's mouth. That is, when a person inhales on the mouthpiece, air is drawn into a first chamber and through the mouthpiece, and smoke is drawn from a cigarette which is in the cigarette receiving compartment into a second chamber, where it is discharged to ambient.

Thus, to the applicant's knowledge, the present invention as herein disclosed is new and novel.

SUMMARY OF THE INVENTION

The present invention comprises a device for smoking tobacco both in a pipe form or in the form of a cigarette, wherein a constant flow of air is drawn through a pipe-like housing and is forced through a mouthpiece. Thus, the smoking device comprises a housing having a bowl in which a cup is removably received. The cup is arranged to hold a sufficient amount of tobacco, and includes openings therein to communicate with an adjacent air chamber which is provided with an outlet stem member adapted to have various mouthpiece members attached thereto.

The housing is provided with a lower body portion wherein a fan mechanism is disposed, the fan mechanism having an electric motor with a fan attached thereto and being positioned within the air chamber, whereby the fan will draw air through the tobacco in the cup and into the air chamber, and then force it directly through the mouthpiece of the pipe.

A self-contained power supply is also provided in the form of one or more batteries which are operated by a switch mounted to the pipe housing.

A separate cover attachment is also contemplated, wherein the cover attachment is mounted over the bowl member and arranged to support a cigarette therein in place of loose tobacco.

OBJECTS AND ADVANTAGES OF THE INVENTION

The present invention has for an important object a provision wherein a pipe device is arranged with a fan mechanism disposed therein, whereby a continuous flow of smoke is established as long as the switch is closed.

It is another object of the invention to provide a power-operated smoking device of this kind, wherein the tobacco is evenly burned as well as completely burned.

It is still another object of the invention to provide a device of this character that is operated by self-contained batteries which provide power to operate the fan mechanism disposed therein.

It is a further object of the invention to provide a pipe and smoking device of this type that is relatively inexpensive to manufacture.

It is still a further object of the invention to provide a device of this character that is simple and rugged in construction.

Still another object of the invention is to provide a smoking device of this type that is capable of including a recharging unit.

The characteristics and advantages of the invention are further sufficiently referred to in connection with the accompanying drawings, which represent one embodiment. After considering this example, skilled persons will understand that variations may be made without departing from the principles disclosed and we contemplate the employment of any structures, arrangements or modes of operation that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figures 1, 2, 3, 4, 5, 6:
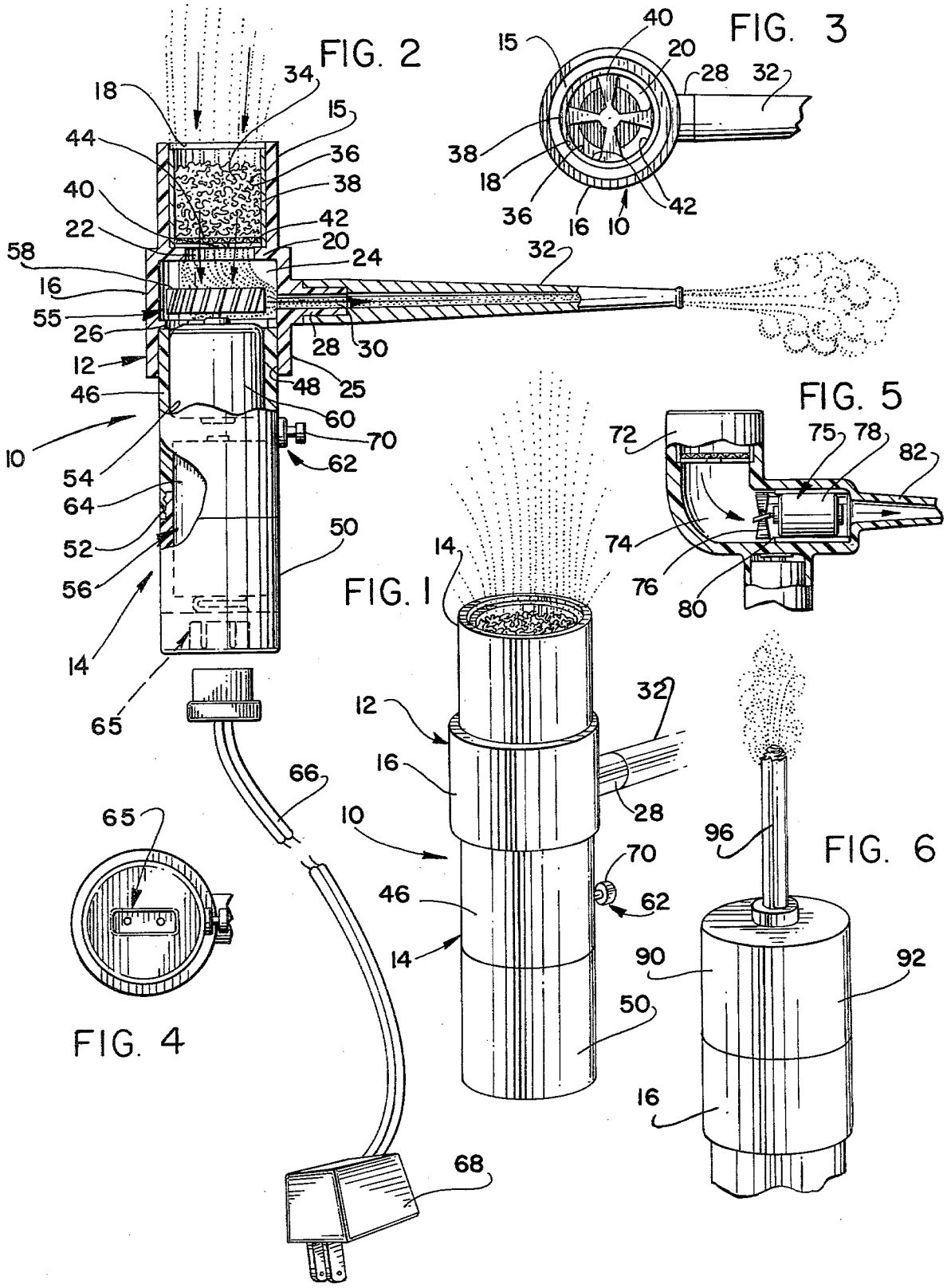
FIG. 1 is a perspective view of the electrically powered smoking device.
FIG. 2 is a partial, cross-sectinal view thereof showing the arrangement of the fan with respect to the pipe bowl and outlet stem.
FIG. 3 is a plan view thereof without the tobacco and support screen therein.
FIG. 4 is a bottom plan view of the pipe housing.
FIG. 5 is a cross-sectional view of an alternative arrangement of the invention.
FIG. 6 is a perspective view showing an adapter for use with cigarettes.

Referring more particularly to FIGS. 1 through 4, there is shown an electrically operated smoking device, generally indicated at 10, constructed with an upper pipe housing 12 and a lower utility housing 14. The upper housing 12 comprises a tobacco bowl member 15 located in a contiguous integral mannerwith a pipe base member 16.

Said bowl member 15 defines a compartment 18 opened at its upper free end and which is provided with an annular bottom wall 20, wherein a central aperture 22 is disposed, said aperture being shown as a single enlarged opening; however, it is contemplated that a plurality of holes could be employed in place thereof. Thus, aperture 22 allows for communication between bowl 15 and air chamber 24 formed in pipe base member 16, wherein said base comprises a peripheral wall 25 having an inner annular flange member 26 disposed therein. Hence, the bottom wall 20 of bowl 15, the top of air chamber 24, and the annular flange member 26 together define chamber 24 within base 16.

Included within base 16 is a laterally extending stem member 28 having a passage 30, wherein said passage 30 connects to chamber 24, the stem member 28 being arranged to receive a removable mouthpiece 32, which is typical in most pipes. However, it is contemplated that various other mouthpieces can be employed therewith.

Accordingly, it can be seen that air is permitted to be drawn through compartment 18 of bowl 15, into chamber 24, and discharge through outlet passage 30 into mouthpiece 32. However, in addition thereto, means are provided whereby a force draft of air is established through chamber 24, and air is caused to flow as stated above, without the individual inhaling through said mouthpiece 32.

Before any further description of the pipe housing is presented, it should be noted that tobacco 34 can be stored or positioned directly in bowl compartment18. However, in the preferred form, there is included a cup member 36 having such a configuration that it can be removably received quite readily in compartment 18, as shown in FIG. 1. The cup comprises an annular wall 38 and a bottom wall 40 in which a plurality of openings 42 are arranged. Thus, tobacco 34 is positioned in cup 36, and is provided with a support screen 44 which prevents the tobacco from entering chamber 24. With the cup being removable from compartment 18, it will allow for easy refilling with various tobaccos, and also provide for ease of cleaning.

The lower utility housing section 14 comprises a two-piece body member having an upper body portion 46 mounted to the lower portion of base member 16. The upper body portion 46 can be affixedly received in recess 48 formed in base 16, or it can be formed as an integral part thereof. The second body piece, being the lower body portion 50, is detachably connected to first body member 46. The connection thereto can be made in any suitable manner, and is herein shown as having a threadable connection 52.

Thus, the utility housing section defines a storage compartment 54, wherein a fan means is disposed along with a self-contained power supply, said fan means being generally indicated at 55, with the power supply being indicated at 56.

Fan means 55 comprises a fan member 58 arranged to be mounted within air chamber 24, as seen in FIG. 2, and operably secured to a small battery-operated motor 60, said motor 60 being positioned in the upper body portion 46 whereby fan 58 is so located that it is juxtapositioned to said outlet passage 30 of stem 28.

Accordingly, as the motor 60 is operated, fan 58 will rotate, creating a downward flow of air through the lit tabacco 34, whereby the smoke therefrom is forced from chamber 24 through passage 30 and mouthpiece 32.

Thus, there is herein included a switching means, indicated at 62, mounted to housing 14, which is electronically interconnected between motor 60 and power supply 56, wherein the power supply comprises at least one battery 64 removably disposed in compartment 54.

It is also contemplated that a recharging means 65 can be readily incorporated within housing 14, whereby a suitable removable electrical wire 66 and charger unit 68 is provided in the well-known manner.

Thus, it can be readily understood that, when a continuous flow of smoke is needed or wanted by the person smoking the pipe, he merely presses button 70 of switch 62 and smoke will be drawn into chamber 24, and forced out mouthpiece 32 until button 70 is released.

Referring now to FIG. 5, there is shown an alternative arrangement of the present invention, wherein the pipe comprises a pipe bowl 72 communicating with an air chamber 24, the fan means 75 being in a different location and arrangement than as previously described. That is, the fan 76 and motor 78 are disposed in an adjacent enlarged duct 80, wherein duct 80 is provided with elongated rib members 82 that allows smoke to pass from chamber 74 into outlet stem 82.

Another arrangement is illustrated in FIG. 6, wherein a cover member 90 provides a means for mounting a cigarette so as to operably communicate with compartment 18 of bowl 15. Cover 90 comprises an inverted cup having an annular wall 92 and a top wall 94, which includes a boss 95 adapted to receive and support cigarette 96, whereby fan means operates in the same manner as previously described.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and we do not wish to be restricted to the specific form shown or uses mentioned, except as defined in the accompanying claims.

We claim:

1. A smoking device providing a regulated continuous flow of smoke therethrough, the device comprising:

a housing having an upper and lower section;

a bowl to receive tobacco therrein, said bowl being formed in said upper section of said housing;

an air chamber juxtaposed to said bowl and formed in said upper section to communicate with said bowl;

a cup member removably disposed in said bowl, said cup having a plurality of openings formed therein adjacent said air chamber in order to receive tobacco therein;

an outlet passage formed in said upper section and positioned to operably communicate with said air chamber;

fan means mounted in said housing and disposed to provide an air flow from said bowl and a discharge through said outlet passage, said means including a fan positioned within said air chamber and an electric motor supported with said housing;

a power supply means electrically connected to said fan means;

wherein said power supply comprises at least one battery mounted in said lower section of said housing;

and wherein said lower section thereof comprises an upper body member and a lower body member, said body members being removably attached to each other;

switch means electrically connected between said fan means and said power supply means, whereby said fan means is selectively operated to provide air flow through said smoking device.

2. A smoking device as recited in claim 1, wherein said motor is disposed in said upper body of said lower sectin of said housing.

3. A smoking device as recited in claim 2, wherein said power-supply means includes a recharging unit.

4. A smoking device as recited in claim 2, including:

a laterally extending stem member wherein said outlet passage is positioned; and a mouthpiece removably mounted to said stem member.

* * * * *